US008602415B1

(12) United States Patent
Denoual

(10) Patent No.: US 8,602,415 B1
(45) Date of Patent: Dec. 10, 2013

(54) DICE GAME

(71) Applicant: Thierry Denoual, Saint Gabriel Brecy (FR)

(72) Inventor: Thierry Denoual, Saint Gabriel Brecy (FR)

( * ) Notice: Subject to any disclaimer, the term of this patent is extended or adjusted under 35 U.S.C. 154(b) by 0 days.

(21) Appl. No.: 13/633,661

(22) Filed: Oct. 2, 2012

(51) Int. Cl.
*A63F 9/04* (2006.01)

(52) U.S. Cl.
USPC ..... 273/146; D21/372; D21/373

(58) Field of Classification Search
USPC ..... 273/146; D21/372, 373
See application file for complete search history.

(56) References Cited

U.S. PATENT DOCUMENTS 4,648,602 A * 3/1987 Maroney ..... 273/146
4,930,780 A * 6/1990 Goodman et al. ..... 273/146
5,405,145 A * 4/1995 Jones et al. ..... 273/146
5,791,649 A * 8/1998 DiSandro ..... 273/243
7,185,889 B2 * 3/2007 VanZanten ..... 273/274
7,871,077 B2 * 1/2011 Calvert ..... 273/146
2008/0203657 A1 * 8/2008 Hole ..... 273/146

* cited by examiner

*Primary Examiner* — Benjamin Layno
(74) *Attorney, Agent, or Firm* — Craig M. Stainbrook; Stainbrook & Stainbrook, LLP

(57) ABSTRACT

The present invention is a poker-based dice game in the tradition of Yacht, but involving simultaneous play by all competitors and the use of a joker to increase the odds of achieving desired combinations, thereby speeding play. All game variations involve rapid inspections of roll results, rapid calculations of probabilities, and quick decision making. The game includes first through sixth sets of six-sided dice, each die of said first through sixth sets of dice having five faces identically marked and bearing numerical indicia, and a sixth side, also identically marked throughout said first through sixth sets of dice and bearing a symbol denoting a wild card value; a set of scoring tiles, each tile in said set of tiles bearing a unique point value; and a scoring sheet.

6 Claims, 3 Drawing Sheets

52

54 54

| FLEET! ROLL, SCORE AND WIN! | Player #1 | Player #2 | Player #3 | Player #4 | Player #5 | Player #6 |
|---|---|---|---|---|---|---|
| 56 ALL TWOS | | | | | | |
| 58 THREE PAIRS | | | | | | |
| 60 ALL THREES | | | | | | |
| 62 ONE PAIR AND ONE FOUR-OF-A-KIND | | | | | | |
| 64 ALL FOURS | | | | | | |
| 66 TWO THREE-OF-A-KIND | | | | | | |
| 68 ALL FIVES | | | | | | |
| 70 STRAIGHT | | | | | | |
| 72 ALL SIXES | | | | | | |
| 74 FLEET!: ALL BOATS | | | | | | |
| TOTAL | | | | | | |

76

FIG. 4

DICE GAME

CROSS REFERENCES TO RELATED APPLICATIONS

Not applicable. The instant application is an original and first-filed United States Utility Patent Application.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

1. Field of the Invention

The present invention relates generally to a dice game, and more particularly to dice game in the tradition of poker dice, and still more particularly to a fast-paced dice matching game using simultaneous play by all competitors.

2. Background Discussion

Dice poker and variations on dice poker are well known. The traditional English game of dice poker has been imported and modified in several countries, including the Latin American game of Generala (sp. "Alert"). The most popular version of dice poker goes by the name of Yacht in Canada, and is variously referred to as Cheerio, Yot, and Yam in the United Kingdom. A version of this game has been popularized in America as YAHTZEE® [a registered trademark of Hasbro, Inc. of Pawtucket, R.I.] The game is a sequence, or turn-based, dice game that has as a principal object to gain the highest number of points possible using a scoring scheme that associates points according to the results of rolls of several dice at a time. It can be played as a kind of solitaire or with a virtually unlimited number of players, but even when played by a group of players, the games involve nothing more than several players playing the solitaire version collectively with the rolls (or turns) by each player taking place in serially, or in order. Several countries have introduced scoring variations, though the general principals of the game remain largely unchanged.

The object of these dice games is to achieve the highest possible score from throwing a group of five (5) six-sided dice during a turn. At each turn, each player gets five dice to roll. All five dice are placed in a dice cup and the cup is covered with a hand and shaken. The cup is then turned over and the dice spilled onto a surface. The dice are allowed to come to rest and the top faces of the dice are inspected for matches, sequences, and the like. Depending on the kind of "hand" the player wishes to achieve during a turn, the player may either score the roll and end the turn, or he/she may select some dice in the roll to set aside as members of the hand yet to be achieved. For instance, a player might roll two dice showing a pair of 2s, and he/she might set those aside as a pair either to try to match on subsequent rolls, or to combine with other matches to achieve a better poker hand (for instance, a full house or two pairs). Under the typical rules, each player has a maximum of three rolls on each turn, which include the initial roll of all five dice, and then two possible but optional re-rolls of some or all dice. After three rolls the player must choose one of several (e.g., 13 categories) of poker hands to score and enter a score for that category.

After a player scores the roll, he passes the cup to the next player. If playing solitaire, he simply initiates a new turn. Again, under the typical rules, the process is repeated in turn until each player has completed 13 rounds, each round addressing one of the 13 possible categories. When the game concludes, each player will have entered a score for each category. The game ends once all 13 categories have been scored. Once a category has been scored, it cannot be scored again for the rest of the game (except for a special category for rolling a five-of-a-kind). The game scorecard plays an important role in the execution and strategic decision making, and scoring either involves entering the total of the pips indicated on the rolled die (upper section) or achieving specified combinations on the die face, such as 3 and 4 of a kind, full house, small and large straights, flush, and the like (lower section). Obviously, the dice combinations correspond to poker hands and even bear the same name.

A special bonus situation arises when a 5-of-a-kind is rolled. Additional rolls of five-of-a-kind reward the player with bonus points or the choice of using the roll as a wild card. The player may also elect to score a "Chance" category or may score any roll in any category at any time, even if the resulting score is zero, which is known as a "scratch" or "dump" score.

In Yacht, as with all card and dice games, luck is the principal element in determining the outcome. However, strategy is also quite important, as each player must elect and scoring in only one scoring category at each turn. Because the number of different scoring combinations equals the number of turns in the game, each player must make difficult at each turn as to when to select a particular category in which to enter a score.

For all their popularity, Yacht, and its American counterpart, YAHTZEE® tend to be slow and tedious, particularly when larger groups of players are involved. Play gets bogged down as players take excruciatingly long amounts of time deciding which combinations they must seek, particularly when successive rolls are unfavorable. If, for instance, six players are competing, with three rolls per turn per player, a competitor can wait 30 rolls before his or her turn resumes. Thus, the pace is slow and players remain generally inactive for long periods of time.

What is needed, therefore, is a Yacht-type dice matching and combining game with a fast pace of play, elements of both chance and skill, and that places a premium on competitors' abilities to make quick judgments about roll probabilities, and quick economical dice rolls.

BRIEF SUMMARY OF THE INVENTION

The present invention is a poker-based dice game in the tradition of Yacht, Generala, YAHTZEE®, and the like, but involves simultaneous play by all competitors involved in the game and the use of a joker to increase the odds of achieving desired combinations, thereby speeding play. The game permits of several variations, all of which involve rapid inspections of roll results, rapid calculations of probabilities, and quick decision making. Thus, the game includes a significant element of skill to take optimal advantage of the luck of the rolls.

BRIEF DESCRIPTION OF SEVERAL VIEWS OF THE DRAWINGS

The invention will be understood and it various objects and advantages better appreciated when consideration is given to the following detailed description thereof. Such description makes reference to the annexed drawings wherein:

FIG. 4 is a schematic view showing the scoring sheet used to keep score while playing the inventive game.

DETAILED DESCRIPTION OF THE INVENTION

Figure 1:
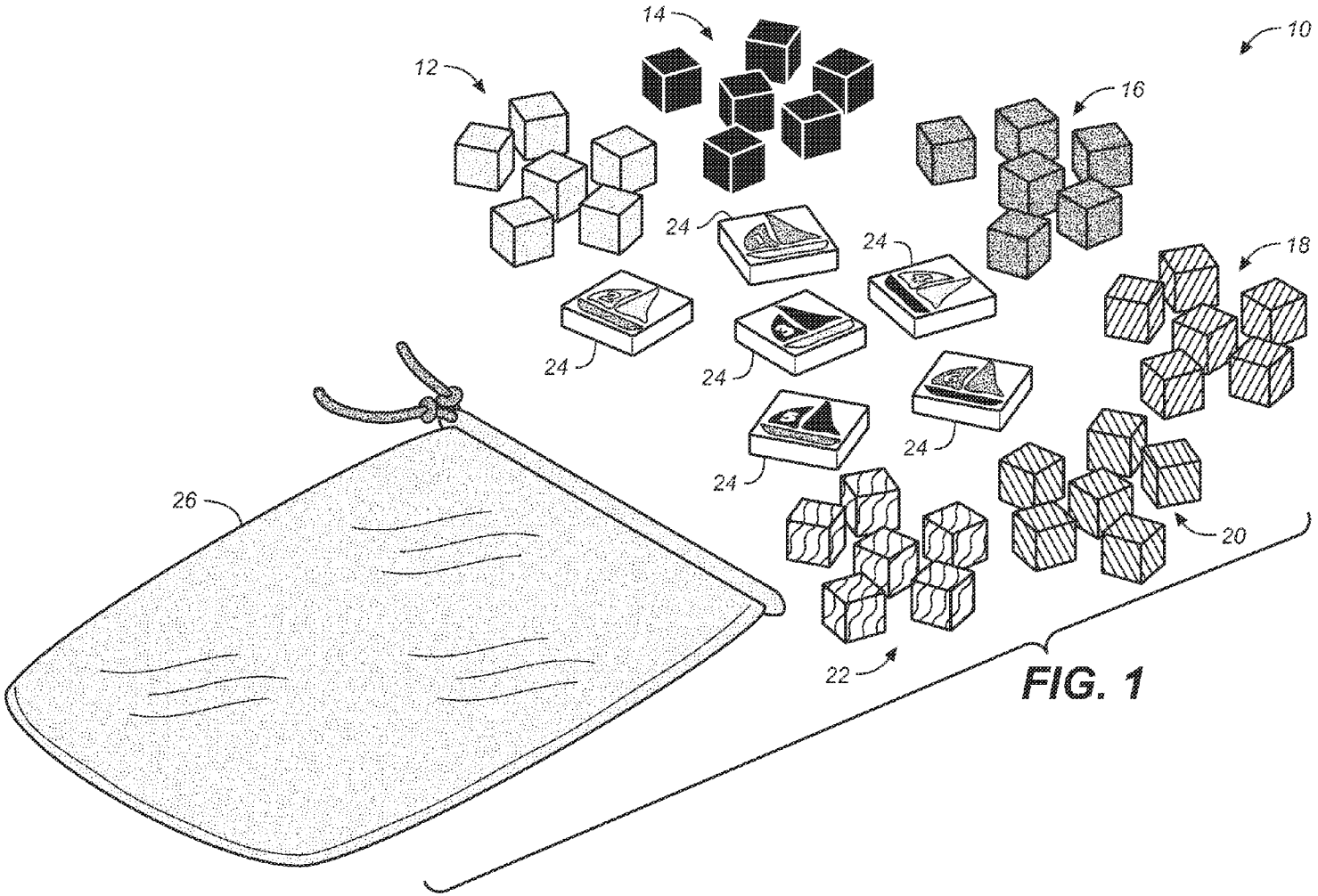
FIG. 1 is an upper perspective view showing the material components of the dice game of the present invention.
Figure 3:
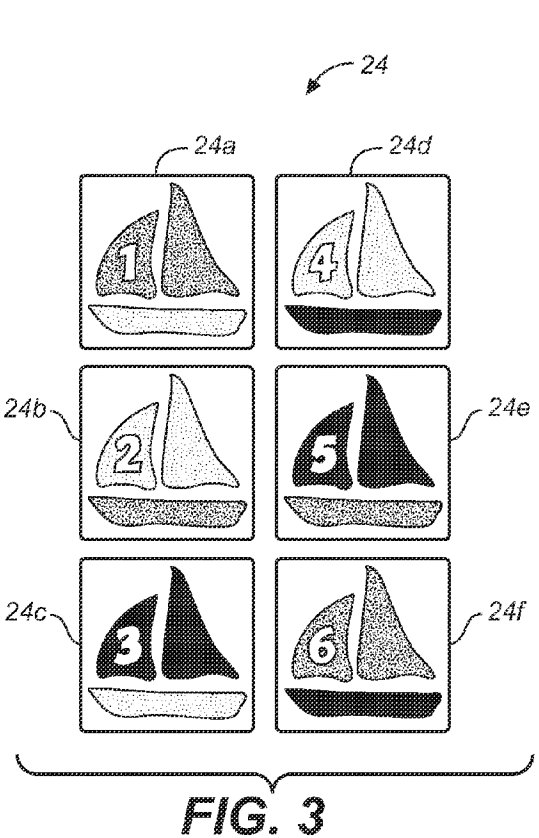
FIG. 3 is a top plan view of the scoring tiles.

Referring to FIGS. 1 through 4, there is illustrated therein a new and improved dice game, generally denominated 10 herein. FIG. 1 shows that the inventive game includes first through sixth sets of six dice, 12, 14, 16, 18, 18, 20, 22; a set of scoring tiles 24, preferably numbered 1 through 6, 24*a*, 24*b*, 24*c*, 24*d*, 24*e*, 24*f* (see FIG. 3); and a dice and tile pouch 26. Optionally, the game may include dice cups, though the rapidity with which the game is played does not lend itself to the use of cups for rolling the dice.

Figure 2:
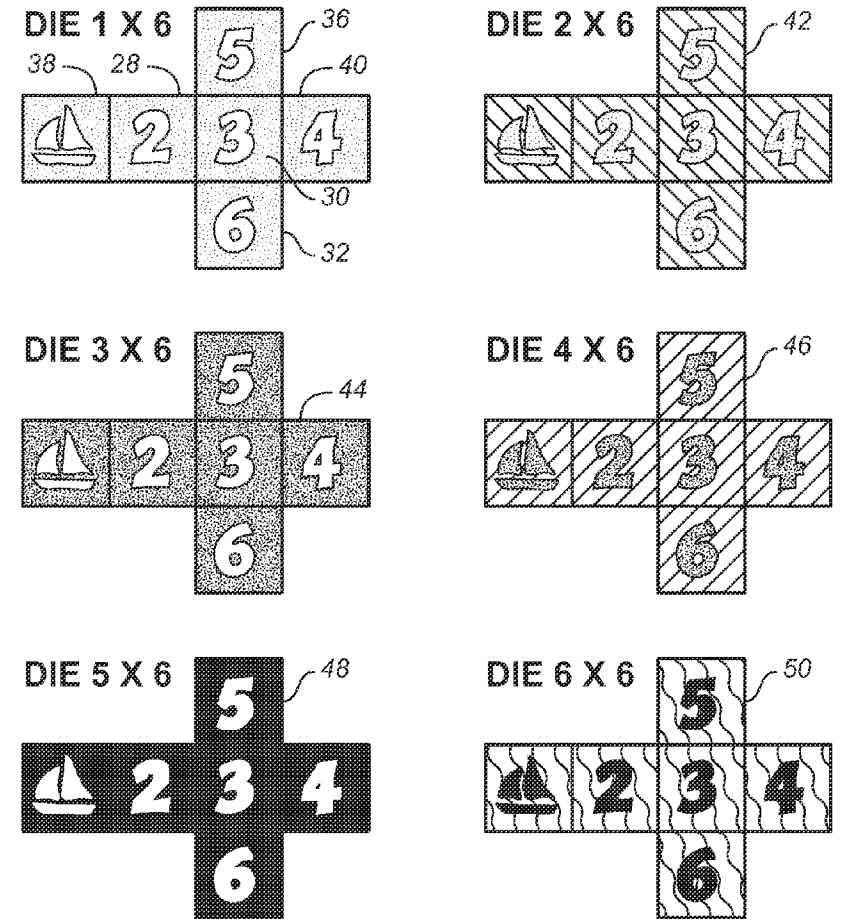
FIG. 2 is a conformal projection of the six-sided dice included in the present invention.

As seen in FIG. 2, all of the dice sets are identically marked with numerical indicia on five faces—e.g., numbers "2" through "6"—28, 30, 32, 34, 36, respectively. The dice are shown bearing Arabic numerals, though it will be appreciated that other numerical indicia (for instance, pips) may be used without departing from the spirit of the game or the scope of the invention. The sixth face 38 bears an arbitrary image (in this instance, a sailboat) which functions as a joker or wild card. A preferred alternative embodiment utilizes a lightning symbol as the wild card/joker symbol. Essentially any desired image may be employed, again without departing from the spirit of the game or the scope of the invention. Each of the six sets of dice are distinguishable by background surface color (hue, tint, tone, shading) or other kinds of background markings, 40, 42, 44, 46, 48, 50.

FIG. 4 shows the scoring sheet 52 used to keep score while playing the inventive game. The sheet includes 6 boxes 54 in which to write the names of the game competitors. Each player's scores are kept in a columnar format. At the left side of the sheet, the various combinations sought to be achieved during the 10 rounds of the game. These include "All Twos" 56 (meaning that six 2s must be rolled to achieve the combination), "Three Pairs" 58, "All Threes" 60, "One Pair and One Four-of-a-Kind" 62, "All Fours" 64, "Two Three-of-a-Kind" 66, "All Fives" 68, "Straight" 70, "All Sixes" 72, and "Fleet! All Boats" 74. At the bottom of the scoring sheet, for each player's column there is provided a "Total" box 76, for tallying and marking the total score achieved after 10 round of rolls (see below for how play proceeds).

In an alternative embodiment of the game, the hands of All Sixes, All Fives, All Fours, All Threes, and All Twos can be eliminated, and a new game card provided showing a single category of "Six of a Kind," along with "All Even" and "All Odd." The game is thus reduced by two rounds and is an eight round game. In all other respects, it is identical to the above described embodiment. It will be appreciated that the game can be increased or decreased in both time and complexity by adding or eliminating combinations to be achieved. Thus, the inventive game is not limited to one or another version of the game as defined by the combinations to be achieved in order to complete a game.

Play of the Game: In preparation for play, each competitor takes one of the six sets 12 through 22 of dice, choosing six dice of the same color. The scoring chips 24 are placed in the center of the play area, with the number of chips corresponding to the number of players competing. If there are four players, for instance, chips 1 through 4, 24*a*, 24*b*, 24*c*, and 24*d*, would be used. Additional players would entail using the other chips, in order; fewer players entails using fewer chips, again using chips beginning with the chip numbered "1" through whatever number corresponds to the number of competitors playing. Each player's name is then written on the scoring sheet 52.

The game is played in ten (10) rounds or either (8) rounds, depending on the game card employed. There are several variations of the rules. In a first preferred set of rules, before each round each player announces which one of the combinations, 56 through 74, he or she will try to achieve in the immediately upcoming round. The players then all count in unison, "1-2-3-GO!" All of the dice are rolled by all players simultaneously on the collective recitation of "GO." When the dice have come to rest, each player quickly examines his or her dice and determines which, if any, to keep to most quickly achieve his or her objective in that round. Those dice are pulled aside proximate the owner, set apart from the dice throwing area, and the results frozen for that round. The players all collect their remaining dice and roll again, and each player again examines the results of the throw to identify dice that contribute to their objective, and any dice that advance the achievement of the objective are collected and set aside with the earlier collected dice. The process of rolling, examining, collecting, and rolling again repeats as rapidly as possible and as many times as are necessary to achieve their predetermined goal, all players rolling simultaneously and in no particular order.

The first player to achieve the predetermined combination shouts, "Fleet!" if a boat symbol is used for the wild card symbol, or "Flash!" if a lightning bolt is employed. These terms are thus used interchangeably herein to signify the game action of announcing a combination. The successful player then selects the highest scoring chip in the middle. Play, however, does not stop. Instead, the other players continue in their efforts, with each player announcing "Fleet!" when his or her combination is achieved. When all but one of the players have shouted "Fleet!" the round is over, and the last player collects the chip worth one point. A score for each player for that round is then written in the box for the combination achieved by that player according to which chip the player happened to collect for the round. Play then moves to the next round with the chips being returned to the middle before commencing the dice rolls.

Importantly, the joker icon on each die can be used to signify any other number or other indicia on the die. This dramatically increases the odds of achieving a desired number on a rolls (increasing the probability from ⅙ to ⅓), and thereby speeding play even further.

After 10 rounds are completed, the game is over. The scores for each player are added and the player with the highest total wins the game.

In a game variant, players do not announce the combination sought to be achieved for that round. Rather, after counting down and rolling the initial roll in a round, the player can determine what to seek based on the results of any roll in the succession of rolls. The same rules as above thereafter apply.

In another game variant, turns are taken by players in deciding in advance which combination must be achieved by all players in any given round. Because not all players may end up with the same number of opportunities to select the necessary combination, first to play is decided by roll of the dice.

In yet another game variant, the players simply achieve each combination in the order in which they appear on the scoring sheet.

In yet another variation, as soon as the penultimate player has achieved his or her desired combination and has announced, "Fleet!", the final player is put on a timer and given a predetermined time to complete either the predetermined combination or any combination remaining to be achieved on his score sheet, depending on the game variation being played. If the combination is not achieved in the allotted time, that player collects no chip for the round.

In still another variation, under any of the foregoing variants, no dice are permanently frozen at any time during a round and may be pulled back into use if subsequent rolls show that it would be advantageous to do so.

And in yet another variation, if it is desirable to place a premium on achieving combinations quickly, an alternative and expanded set of scoring chips can be provided with values ranging more broadly than 1 through 6. For instance, the lowest scoring chip might take the value "1," while the highest chip takes the value "40" and the players can decide the ranges for the game. If six players were to participate, they might agree that the chip values would be, in order from lowest to highest, 1, 3, 8, 15, 25, and 40; or perhaps 1, 5, 10, 20, 50, and 100. Such flexibility in assigning chip values would be useful in actual money stakes games as it would enable players to assign values corresponding to denominations of currency available in the country in which they play.

The game is suitable for play by anyone aged 7 years and older. While it is structured for play by six players simultaneously, there is no reason that additional score sheets and additional sets of dice could not be used to increase the number of competitors in a given game. Further, and as will be appreciated from the foregoing descriptions of game variations, there are manifold variations on the game and on the variations of the game. The essential aspect of the game informs each such variation.

The above disclosure is sufficient to enable one of ordinary skill in the art to practice the invention, and provides the best mode of practicing the invention presently contemplated by the inventor. However, the foregoing description and illustrations should not be construed as limiting the scope of the invention, which is defined by the appended claims.

What is claimed is:

1. A dice game, comprising:

first through sixth sets of six-sided dice, each die of said first through sixth sets of dice having five faces identically marked and bearing numerical indicia and a sixth side, also identically marked throughout said first through sixth sets of dice and bearing a symbol denoting a wild card value;

a set of scoring tiles, each tile in said set of tiles bearing a unique point value; and a scoring sheet used to keep score while playing the dice game, said scoring sheet including a plurality of spaces for entering the names of game competitors, a listing of various numerical combinations sought to be achieved during the game, and a plurality of spaces for totaling each players scores.

2. The dice game of claim 1, wherein said dice are each marked with indicia signifying numbers 2 through 6.

3. The dice game of claim 2, wherein said set of scoring tiles includes six tiles numbered 1 through 6.

4. The dice game of claim 1, wherein said set of scoring tiles includes six tiles numbered 1 through 6.

5. The dice game of claim 1, wherein each of said first through sixth sets of dice have a distinctive background that makes each set readily distinguishable visually from every other set in use in a game.

6. The dice game of claim 1, wherein the listing of combinations on said scoring sheet includes, All Twos, Three Pairs, All Threes, One Pair and One Four-of-a-Kind, All Fours, "Two Three-of-a-Kind", "All Fives", "Straight", "All Sixes", and "All Wild Cards".

* * * * *